United States Patent [19]

Coughlin

[11] 4,403,007

[45] Sep. 6, 1983

[54] FILLED THERMOPLASTIC COMPOSITIONS BASED ON ETHYLENE INTERPOLYMERS AND POLYESTER, POLYETHER AND POLYETHER ESTER PLASTICIZERS

[75] Inventor: Michael C. Coughlin, Wilmington, Del.

[73] Assignee: E. I. Du Pont de Nemours & Co., Wilmington, Del.

[21] Appl. No.: 273,419

[22] Filed: Jun. 15, 1981

Related U.S. Application Data

[63] Continuation-in-part of Ser. No. 176,781, Aug. 11, 1980, abandoned.

[51] Int. Cl.[3] ..... C08K 5/06; C08K 5/10; B32B 27/36; B32B 27/32

[52] U.S. Cl. ..... 428/95; 428/96; 428/97; 524/13; 524/14; 524/15; 524/296; 524/321; 524/377

[58] Field of Search ..... 524/563, 321, 559, 377, 524/612, 296, 425, 474, 427, 13, 14, 15, 442, 445, 437, 423, 609; 428/95, 96, 97

[56] References Cited

U.S. PATENT DOCUMENTS

| | | | |
|---|---|---|---|
| 3,010,899 | 11/1961 | Boyer | 252/29 |
| 3,361,702 | 1/1968 | Wartman et al. | 260/33.2 |
| 3,492,258 | 1/1970 | Kremer | 260/27 |
| 3,927,244 | 12/1975 | Ogura et al. | 428/483 |
| 4,041,002 | 8/1977 | Aboshi et al. | 524/503 |
| 4,085,082 | 4/1978 | Lamb et al. | 260/31.6 |
| 4,191,798 | 3/1980 | Schumacher et al. | 428/95 |
| 4,222,924 | 9/1980 | Schumacher | 524/445 |
| 4,242,395 | 12/1980 | Zuckerman et al. | 428/96 |
| 4,243,568 | 1/1981 | Brown | 524/563 |
| 4,243,576 | 1/1981 | Fisher et al. | 525/211 |
| 4,263,196 | 4/1981 | Schumacher et al. | 526/563 |
| 4,335,034 | 6/1982 | Zucherman et al. | 524/524 |

FOREIGN PATENT DOCUMENTS

| | | |
|---|---|---|
| 50-99730 | 8/1975 | Japan . |
| 50-151243 | 12/1975 | Japan . |
| 940713 | 10/1963 | United Kingdom . |

OTHER PUBLICATIONS

Nakamura et al., Japan Kokai 77,238.
Nuova Chim., 1972, 48, (12,29–32), Larsen.
Handbook of Adhesives, (Skeist), 1977, Chapter 30.

*Primary Examiner*—Melvyn I. Marquis
*Assistant Examiner*—Herbert J. Lilling

[57] ABSTRACT

Filled thermoplastic compositions useful, e.g., as sound-deadening sheeting for automotive carpet are obtained by blending about 5–55% by weight of an ethylene interpolymer, such as ethylene/vinyl ester, ethylene/unsaturated mono- or dicarboxylic acids or esters of said unsaturated acids, etc.; about 1–15% by weight of a plasticizer selected from the group consisting of polyesters, polyethers, polyether esters and combinations thereof with processing oil; about 40–90% by weight of filler; and optionally modifying resins, such as unvulcanized elastomeric polymers and certain other ethylene and propylene homo- and copolymers.

23 Claims, No Drawings

FILLED THERMOPLASTIC COMPOSITIONS BASED ON ETHYLENE INTERPOLYMERS AND POLYESTER, POLYETHER AND POLYETHER ESTER PLASTICIZERS

This application is a continuation-in-part of my copending application Ser. No. 176,781 filed Aug. 11, 1980.

BACKGROUND OF THE INVENTION

1. Field of the Invention

This invention relates to filled blends of ethylene interpolymers and more specifically it relates to filled blends of ethylene polymers plasticized with polyester, polyether and polyether ester plasticizers.

2. Description of the Prior Art

The use of plasticizers with ethylene copolymers generally is not common. Most ethylene copolymers, of which ethylene/vinyl acetate copolymers are the most widely used, are used principally to form films for packaging applications, molded parts, such as shoe soles, and extruded shapes, such as tubing. Where the benefits of plasticization such as greater flexibility, are required, the concentration of comonomer, which acts as an internal plasticizer, can be adjusted to an appropriate level. In binary blends containing fillers, physical properties typically suffer with increasing filler content: melt index decreases, resulting in higher power requirements for processing; elongation and flexibility decline, that is, the blends become more brittle; and modulus increases. These effects can be offset to some degree by changes in copolymer composition, particularly at low filler levels. However, the practical limit for addition of medium density fillers such as calcium carbonate, bauxite, gypsum, etc. is about 60% by weight. As this level is approached physical properties deteriorate to the point where the mixture is of little practical use, and it becomes difficult or impossible to prepare homogeneous blends using standard commercial methods.

Boyer U.S. Pat. No. 3,010,899 discloses blends of ethylene/vinyl acetate resin and mineral oil which are either rubbery or grease like depeneding upon the proportion of oil to resin and can be used as a substitute for crepe rubber or as a grease. It is further disclosed that fillers such as carbon black or finely divided clays can be added to the rubbery products to increase hardness and produce materials suitable as floor tile. As indicated for example in Claim 11, the filler, carbon black, is present in a "minor-amount" while the oilethylene/vinyl acetate copolymer mixture is present in a "major amount".

Nakamura et al. Japan Kokai No. 78 77, 238 discloses the use of a polyester plasticizer in filled polypropylene with other additives to improve heat resistance. In a specific example a blend consisting of 35 parts of polypropylene, 65 parts of calcium carbonate, 1.3 parts of polyester plasticizer, 0.2 parts of dimyristyl thiodipropionate, 0.1 parts of calcium stearate, and 0.05 parts of antioxidant gave heat resistance of 520 hr in a 145° C. air oven compared to 230 hr for a control containing dioctyl phthalate instead of the polyester.

Taira, et al., Japanese Pat. No. 5 0151-243 discloses the use of magnesium and aluminum silicates in high density polyethylene plasticized with a polyester plasticizer to improve antistatic properties. These compositions are disclosed to contain up to 150 parts of filler and 40 parts of polyester plasticizer per 100 parts of resin.

Lamb et al., U.S. Pat. Nos. 4,085,082, 4,085,083, and 4,111,888, disclose the use of polyesters prepared from a dibasic acid, ethylene glycol, and an aliphatic alcohol, from a dibasic acid, a polyethylene glycol and an aliphatic alcohol, and from a phthalic acid, ethylene glycol, diethylene glycol or polyethylene glycol and an aliphatic alcohol, respectively, in unfilled ethylene/vinyl[3]acetate copolymers containing at least 55% vinyl acetate. The plasticized compositions provided improved film clarity and improved extractability.

Larsen in "Action of Additives on High Molecular Weight Polyethylene" (Nuova Chim. 1972, 48(12), 29-32) describes the use of plasticizers in blends containing high molecular weight polyethylene and inert clay fillers to modify processing characteristics without significantly affecting physical properties. Polyester plasticizers were one of the types of plasticizers mentioned.

Schumacher and Yllo U.S. Pat. No. 4,191,798 discloses the use of processing oils, particularly naphthenic and aromatic oils, in blends of ethylene interpolymers and fillers. Specifically, the inclusion of a processing oil in blends of ethylene copolymers and fillers allows the preparation of higher filler level containing blends that can be attained in corresponding binary polymer/filler blends.

In the "Handbook of Adhesives" second edition, edited by Irving Skeist, published by the Van Nostrand, Reinhold Company in 1977, Chapter 30 written by J. T. Domine and R. H. Schaufelderg in a review of hot melt compositions it is disclosed that plasticizers or liquid modifiers are used to a limited extent in order to impart properties such as flexibility, specific wetting and viscosity characteristics to ethylene copolymer based hot melt compositions. The liquid plasticizers proposed for such use generally speaking belong to the class of organic esters, however, other liquid substances, for example, chlorinated polynuclear aromatic compounds have also been suggested. The particular plasticizer and the proportion thereof employed in a given composition depends upon several factors. Important considerations are the cost and compatibility of the plasticizer with the other ingredients of the composition, particularly with the ethylene copolymer.

Polyethers and polyether esters are commonly used as surface active agents in combination with ethylene copolymers. For example, Japanese Patent Publication No. 099-730/74, (Japanese Patent Appln. No. 012058/73) discloses the use of up to 15% of polyethylene glycol sorbitol ester or ether ester surfactant added to unfilled ethylene/vinyl acetate based hot melt adhesive formulations making such formulations water soluble.

U.S. Pat. No. 3,492,258, discloses the use of poly(oxyalkylene) glycol mono-fatty acid esters as release agents in wax coatings containing ethylene/vinyl acetate copolymers. These release agents migrate to the surface of the coating and thus impart strippability to the wax coatings. There is no filler used in these compositions.

U.S. Pat. No. 3,927,244 discloses a blend of a polyglycol terephthalate and an ethylene/vinyl acetate copolymer as a heat-bondable coating on a polyester film. The polyglycol terephthalate, which is present at a level ranging from 60 to 99.9 wt. % in this blend, is a condensation product of a polyglycol, such as polyethylene glycol, with a degree of polymerization ranging from 10 to 100, and terephthalic acid; the degree of polymerization of the copolymer of the polyglycol and terephthalic acid ranges from 10 to 500. The function of the polyglycol terephthalate in this blend is to provide adhesion to the polyester film substrate; the ethylene/vinyl acetate acts as a toughening agent where such coatings must survive impact or other abuse. The addition of fillers such as dyes, organic or inorganic pigments, and metal powders, at levels ranging up to 200 parts per hundred based on the polymer blend, is also claimed.

U.S. Pat. No. 3,361,702, discloses polyethylene glycol, polypropylene glycol, and adducts of propylene oxide with glycerol and sorbitol, for example, as plasticizers in unfilled compositions of ethylene/acrylic acid and ethylene/methacrylic acid copolymers, containing less than 25% by weight of the acid or monomer, and their sodium salts.

British Pat. No. 940,713 discloses the use of polyethers and polyether esters with ethylene/vinyl acetate copolymers primarily for but not limited to, vulcanized compounds. The polyethers described are homopolymers of ethylene oxide, propylene oxide, or butylene oxide. The use of fillers is disclosed, silicic acid and carbon black being mentioned in particular. Although specific concentrations are not discussed, it is stated that fillers can be used in very large amounts. The highest filler concentration disclosed in the examples of this patent was 30 parts filler per 100 parts of ethylene copolymer in a crosslinked composition, containing other ingredients as well (i.e., about 22–23% filler based upon the weight of the filled composition).

U.S. Pat. No. 4,242,395 discloses thermoplastic compositions which are useful as backings for automotive carpets. These compositions comprise at least 60 percent by weight of inert mineral filler, 5 to 25 percent by weight of an ethylene homopolymer or copolymer (e.g. ethylene/vinyl acetate, ethylene/ethyl acrylate), 1 to 10 percent by weight of a nonvulcanized elastomeric resin, and 1 to 15 percent by weight of a plasticizer. The plasticizers disclosed include oils employed in rubber compounds and plasticizers commonly used with polyvinyl chloride. Of the latter type phthalates, terephthalates and epoxidized oils were mentioned specifically. The relatively low molecular weight, liquid plasticizers were indicated to be preferred. Apparently the preferred hydrocarbon oils and polyvinyl chloride plasticizers give equivalent property performance. No specific mention is made of polyesters, or of polyethers, or their mixtures with hydrocarbon oils, as plasticizers. It is disclosed that part or all of the ethylene copolymer can be replaced with polyethylene.

SUMMARY OF THE INVENTION

According to the present invention there is provided a composition consisting essentially of (a) from about 5 to about 55% by weight of at least one copolymer of ethylene with at least one comonomer selected from the group consisting of vinyl esters of saturated carboxylic acids wherein the acid moiety has up to 4 carbon atoms, unsaturated mono- or dicarboxylic acids of 3 to 5 carbon atoms, the salts of said unsaturated acids, and esters of said unsaturated acids wherein the alcohol moiety has 1 to 8 carbon atoms, the ethylene content of said copolymer being from about 40 to about 95% by weight, the comonomer content of said copolymer being from about 5 to about 60% by weight, and the melt index of said copolymer being from about 0.1 to about 150, provided that when said copolymer of ethylene is an ethylene/vinyl ester or ethylene/unsaturated mono- or dicarboxylic acid ester said copolymer can contain up to about 15% by weight of carbon monoxide or sulfur dioxide; (b) from about 1 to about 15% by weight of at least one plasticizer selected from the group consisting of polyesters, polyethers, polyether esters, and combinations thereof with processing oil; (c) from about 40 to about 90% by weight of filler; (d) from 0 to about 27.5% by weight of unvulcanized elastomeric polymer; and (e) from 0 to about 44% by weight of olefin polymer selected from the group consisting of low density branched polyethylene, high density linear polyethylene, linear copolymers of ethylene and another olefin comonomer, polypropylene and copolymers of propylene and ethylene where the ethylene content is up to 20% by weight.

Further provided according to the present invention are the above compositions in the form of a sound deadening sheet.

Still further provided according to the present invention are carpets and especially automotive carpets having a backside coating consisting essentially of the above compositions.

As used herein the term "consisting essentially of" means that the named ingredients are essential, however, other ingredients which do not prevent the advantages of the present invention from being realized can also be included.

DETAILED DESCRIPTION OF THE INVENTION

It has been found that the use of a polyester, polyether or polyether ester plasticizer in blends of ethylene copolymers and fillers imparts a balance of properties not found in similar compositions of this type where other types of plasticizers are used. In particular, an unusual degree of flexibility and toughness is obtained which is not normally achieved, especially at high filler concentrations.

The ethylene copolymers suitable for the composition of the present invention are copolymers with at least one comonomer selected from the group consisting of vinyl esters of saturated carboxylic acids wherein the acid moiety has up to 4 carbon atoms, unsaturated mono- or dicarboxylic acids of 3 to 5 carbon atoms, the salts of said unsaturated acids, and esters of said unsaturated acids wherein the alcohol moiety has 1 to 8 carbon atoms. Terpolymers of ethylene and the above comonomers are also suitable. Ionomers, which are the completely or partially neutralized copolymers of ethylene and the acids described above, are discussed in more detail in U.S. Pat. No. 3,264,272. In addition, terpolymers of ethylene/vinyl acetate/carbon monoxide or ethylene/methyl acrylate/carbon monoxide containing up to about 15% by weight of carbon monoxide can also be employed.

The ethylene content of the copolymer is from about 40 to about 95% by weight and the comonomer content is from about 5 to about 60% by weight. The preferred ethylene and comonomer level is from about 45 to about 90% and from about 10 to about 55% by weight, respectively. Most preferably the ethylene and comonomer level is from about 60% to about 85% and from about 15 to about 40% by weight, respectively. A mixture of two or more ethylene copolymers can be used in the blends of the present invention in place of a single copolymer as long as the average values for the comonomer content will be within the above indicated range. Significant, unexpected improvements, especially in tensile elongation, obtained by the use of certain combinations of at least two ethylene copolymers in place of a single ethylene copolymer are the subject matter of applications Ser. No. 176,782 filed Aug. 11, 1980, Ser. No. 251,989, filed Apr. 6, 1981, and simultaneously being filed application Ser. No. 273,420, filed June 15, 1981 now U.S. Pat. No. 4,379,190 the disclosure of applications are hereby incorporated by reference.

Melt index of the copolymer can range from about 0.1 to about 150, preferably from about 0.3 to about 50, and most preferably from about 0.7 to about 10.

Physical properties, principally elongation, decline to lower levels when the ethylene copolymer melt index is above about 30. A lower melt index range, about 0.7 to 10, is most preferred to maintain strength.

Generally from about 5 to about 55% by weight of ethylene copolymer is employed in the composition of the present invention, preferably from about 10 to about 50% by weight, and most preferably, from about 15 to 30% by weight.

In accordance with the above, suitable ethylene copolymers include ethylene/vinyl acetate, ethylene/acrylic acid and its ionomers, ethylene/methacrylic acid and its ionomers, ethylene/methyl acrylate, ethylene/ethyl acrylate, ethylene/isobutyl acrylate, ethylene/normal butyl acrylate, ethylene/isobutyl acrylate/methacrylic acid and its ionomers, ethylene/normal butyl acrylate/methacrylic acid and its ionomers, ethylene/isobutyl acrylate/acrylic acid and its ionomers, ethylene/normal butyl acrylate/acrylic acid and its ionomers, ethylene/methyl methacrylate, ethylene/vinyl acetate/methacrylic acid and its ionomers ethylene/vinyl acetate/acrylic acid and its ionomers, ethylene/vinyl acetate/carbon monoxide, ethylene/methyl acrylate/carbon monoxide, ethylene/normal butyl acrylate/carbon monoxide, ethylene/isobutyl acrylate/carbon monoxide, ethylene/vinyl acetate/monoethyl maleate and ethylene/methyl acrylate/monoethyl maleate. Particularly suitable copolymers are ethylene/vinyl acetate, ethylene/ethyl acrylate, ethylene/methyl acrylate, ethylene/isobutyl acrylate, and ethylene/methyl methacrylate copolymers.

Unvulcanized elastomeric polymers are of interest as modifying resins for the blends of the present invention. They exhibit good compatibility in the blends and can be useful for obtaining increased flexibility and/or melt strength. When these polymers are used in combination with the ethylene copolymers described previously, they can range in concentration from 0 to about 27.5% by weight, preferably from about 1 to about 22.5% by weight, and most preferably from about 2 to about 12% by weight of the composition of the present invention. A variety of different rubbers can be used including styrene-butadiene rubber, polyisobutylene, ethylene/propylene rubbers, and terpolymers of ethylene, propylene, and a diene monomer (EPDM). Preferred rubbers are the ethylene/propylene and the EPDM polymers in which the ethylene content can range from above 20% by weight to about 80% by weight. The diene comonomer is usually methylene norbornene, ethylidene norbornene, dicyclopentadiene, or 1,4-hexadiene, although other dienes may be used, and the concentration of the diene is usually less than 5% by weight. The Mooney viscosity is preferably in the range of 20 to 90.

Another class of modifying resins useful in the practice of this invention are the low density branched homopolymers of ethylene, the high density linear homopolymers of ethylene, the linear copolymers of ethylene and another olefin monomer, homopolymers of propylene, and copolymers of propylene and ethylene where the ethylene content is up to 20% by weight. For reasons of compatibility and the balance of properties obtained, the preferred materials are the high density ethylene homopolymers, the linear copolymers of ethylene and another olefin, and the copolymers of propylene and ethylene. The olefin content and the olefins used in the linear copolymers are described in U.S. Pat. No. 4,076,698. The propylene/ethylene copolymers may contain up to 20% by weight ethylene. When used in combination with the ethylene copolymers described previously in compounds of the present invention, materials with an unusual range of properties result. These properties include the high density useful in sound deadening applications, low cost due to the high filler content, good toughness due to the presence of the ethylene copolymers and to the use of the polyester and the polyether plasticizers of this invention, very high stiffness due to the modifying resins, and good adhesion due to the presence of the ethylene copolymer(s) described previously. The members of this class of modifying resins can be present in an amount of from 0 to about 44% by weight, preferably from about 1 to about 37.5% by weight, and most preferably from about 3 to about 18% by weight of the composition of the present invention.

The polyester plasticizer component of the present invention is, in general, a liquid, condensation product of a polybasic acid and a polyol. The term "liquid" in the context of the present invention is used to mean pourable at room temperature. The acid component is most often a saturated aliphatic dibasic acid or an aromatic dibasic acid; adipic acid, azelaic acid, phthalic acid, sebacic acid, and glutaric acid, or mixtures of these acids are commonly used. The polyol can be an aliphatic polyol or a poly oxyalkylene polyol, such as, ethylene glycol, propylene glycol, 1,4- and 1,3-butane glycol, diethylene glycol, and polyethylene glycol. Preferred polyester compositions would consist of an acid component of which greater than 50% by weight are aliphatic dibasic acids, and a polyol component of aliphatic polyol or even more preferably aliphatic glycol. Most preferred compositions are based on adipic or azelaic acid, and propylene glycol or the 1,3- or 1,4-butane glycol. The molecular weight of these plasticizers can vary from a low of a few hundred up to a high of about 10,000. The molecular weight of commercial products is seldom specified; however, typically in the trade, the molecular weight range of the product is classified as low, medium, or high. The preferred range for purposes of this invention is that classified as medium.

Mixtures of polyesters with hydrocarbon oils are also effective plasticizers in the present invention. One objective of using such a mixture is to couple the high efficiency of the relatively high cost polyester with the low cost of the hydrocarbon oil. The cost/performance of a compound plasticized with such a mixture can be improved significantly for a given application because properties can be tailored more precisely, or filler levels can be increased. Actually certain advantages in the performance of the blends of the present invention are obtained as will be discussed below, when such a mixture is used as the plasticizer.

The oil ingredient of the composition of the present invention is known as processing oil. Three types of processing oils are known—paraffinic, aromatic and naphthenic. None of these are pure, the grades identify the major oil type present.

Paraffinic oils tend to "bleed" from blends. Bleeding is normally not desirable, but could be useful in specialty applications, for example, in concrete forms where mold release characteristics are valued.

On the other hand, naphthenic and aromatic oils are nonbleeding when used in proper ratios and are thus preferable.

Processing oils are also subdivided by viscosity range. "Thin" oils can be as low as 100–500 SUS (Saybolt Universal Seconds) at 100° F. (38° C.). "Heavy" oils can be as high as 6000 SUS at 100° F. (38° C.). Processing oils, especially naphthenic and aromatic oils with viscosity of from about 1500 to 6000 SUS at 100° F. (38° C.) are preferred.

Considerations in selection of the processing oil relative to compatibility for purposes of the compositions of the present invention are as set out in detail in Schumacher and Yllo U.S. Pat. No. 4,191,798, the disclosure of which is hereby incorporated by reference.

When used alone, the amount of polyester plasticizer in the composition of the present invention is from about 1 to about 15% by weight, preferably from about 2 to about 12% by weight. Most preferably when using a filler of medium density, such as calcium carbonate, the amount of plasticizer is from about 3 to about 8% by weight, and when using a filler of higher density, such as barium sulfate, the amount of plasticizer is from about 4 to about 8% by weight.

Where a mixture of the polyester plasticizer and a hydrocarbon oil is employed, the relative proportions of the two components can be varied over a wide range depending upon performance objectives. Mixtures containing 50% or less of the polyester are preferred for economic reasons, and most preferred are those containing 20% or less of the polyester.

A separate class of plasticizers, polyethers and polyether esters, are also effective plasticizers in blends of the ethylene copolymers and fillers described above. In general, polyethers are oligomers or polymers of alkylene oxides; polymers of ethylene or propylene oxide are the most common types available commercially. Polyethers can be prepared by polymerization of aldehydes using various types of catalysts, or by acid or base catalyzed polymerization of an alkylene oxide, for example. Polyethers can be terminated by hydroxyl groups to form the diol (glycol) or, in the case of adducts of alkylene oxides with glycerol, for example, the triol, and so forth. The hydroxyl terminated polyether can also be reacted with an acid, fatty acids such as lauric and stearic acids are commonly used, to form the ester; the most common examples of these compounds are the mono- and diesters of polyethylene or polypropylene glycol. The molecular weight of polyethers may range up to those typical of high polymers.

Preferred polyether compositions in the practice of this invention are those consisting of the polyols based on random and/or block copolymers of ethylene oxides and propylene oxides. The copolymer polyols provide better performance in terms of efficiency in compounds of the present invention containing very high levels of filler. Examples 25 and 27, in which a triol based on a random copolymer of ethylene oxide and propylene oxide and a triol based on propylene oxide only, respectively, are compared in compounds containing >70% filler, demonstrate this clearly.

The amount of polyether plasticizer in the composition of the present invention is from about 1 to about 15% by weight, preferably from about 2 to about 12% by weight. Most preferably, when using a filler of medium density, such as calcium carbonate, the amount of plasticizer is from about 3 to 8% by weight, and when using a filler of higher density, such as barium sulfate, the amount of plasticizer is from about 4 to about 8% by weight.

Mixtures of the polyether or the polyether ester plasticizers with either a polyester plasticizer or a hydrocarbon processing oil can also be used in the practice of this invention. The advantage of polyether/polyester combination is the lower cost since the polyethers are cheaper than the polyesters. Combinations of polyether and processing oil are also cheaper because of the lower cost of the oil.

The relative proportions of the two components in a polyether/polyester combination will be adjusted according to the efficiency of the system based on property requirements and cost. Those based on polyester primarily will not be as stiff and will be more expensive, for example, then those based primarily on a polyether or polyether ester.

Where a mixture of the polyether or polyether ester and a hydrocarbon oil is employed, the relative proportions used will again depend upon cost and property requirements. Since the polyethers are more expensive than the processing oils, mixtures containing 50% or less of the polyethers are preferred.

As referred to above a mixture of processing oil, on the one hand, and polyester or polyether or polyether ester, or any combination thereof, on the other hand, can also be used very effectively as the plasticizer for the compositions of the present invention. In fact, such a two- or more component plasticizer system, comprising from about 50 to about 95 percent by weight of processing oil, gives higher tensile elongation than can be obtained using either plasticizer alone at the same level. Maximum elongation is achieved using a mixture of processing oil and polyester or polyether or polyether ester or any combination thereof comprising from about 50 to about 80 percent by weight of processing oil.

Where a mixture of plasticizers is used, the amount of plasticizer may range from about 2 to about 15% by weight, preferably from about 4 to about 12% by weight. Most preferably when using a filler of medium density, such as calcium carbonate, the amount of plasticizer is from about 5 to about 10% by weight, and when using a filler of higher density, such as barium sulfate, the amount of plasticizer is from about 4 to about 8% by weight.

The third essential ingredient of the composition of the present invention is the filler. The percentage of filler that can be included in the composition of the present invention on a weight basis is primarily a function of the density of the filler. Particle size of the filler has some effect. Fine particle size fillers generally have a tendency to result in higher blend viscosities, and they are also more expensive. The use of fine filler, especially at high filler loading, results in a smoother extrudate surface when molten blend is extruded through a die orifice. The attendant benefits of using fine particle size filler in filled polymer blends are described in patent application Ser. No. 052,927 filed June 27, 1979, issued on Apr. 21, 1981 as U.S. Pat. No. 4,263,196 the disclosure of which is hereby incorporated by reference. No.

9 Whiting (calcium carbonate) which has been used extensively in the present compositions (about 95 percent through 325 mesh) represent a viable midpoint in coarseness, availability, and cost.

Examples of suitable fillers are calcium carbonate, barium sulfate, hydrated alumina, clay, magnesium carbonate, calcium sulfate, silica, flyash, cement dust, wood flour, ground rice hulls and mixtures thereof.

Most preferred fillers are calcium carbonate, barium sulfate, hydrated alumina, and mixtures thereof.

The amount of filler used may range from about 40 to about 90 percent by weight. Where higher density compositions are needed, particularly for sound deadening applications, the preferred filler concentration will range from about 50 to about 85 percent by weight. Most preferably, when using a filler of medium density, such as calcium carbonate, or hydrated alumina the amount of filler is from about 65 to about 80 percent by weight, and when using a filler of higher density, such as barium sulfate, the amount of filler is from about 70 to about 85 percent by weight.

Polymers, both homo- and copolymers, other than the ones referred to above, can also be used to some extent in combination with the above specified polymers without significantly interfering with the advantages obtained by the present invention. Similarly other ingredients can also be added to the compositions of the present invention by a compounder in order to obtain some desired effect, such as reduction of cost, or enhancement of physical property. Accordingly, extender resins, waxes, foaming agents, crosslinking agents, antioxidants, flame retardant agents, etc. that are widely used, can be included in the compositions of the present invention.

The blends of the present invention are thermoplastic in nature and therefore can be recycled after processing. The recycled material may also contain textile fibers, jute, etc. present in the trim obtained during production of the finished product (e.g., back-coated automotive carpet).

A commercially sized batch-type Banbury or equivalent intensive mixer is entirely suitable for preparing the compositions of the present invention. A Farrel continuous mixer ("FCM") is also an excellent mixing device. In either instance, dry ingredients are charged in routine fashion. It is convenient in most cases to inject the plasticizer component directly into the mixing chamber of either unit as per widely used practice with this type of equipment. When more than one plasticizer is used, and where any one of the plasticizers is present in a small amount (less than about 10 weight percent of the total plasticizer mixture), the plasticizers should be preblended before addition to the other ingredients of the present invention. This will facilitate uniform distribution of each plasticizer component in the final composition and thus ensure that optimum properties are obtained. If desired, the copolymer and the plasticizer(s) can be precompounded as a "Masterbatch" in a suitable intensive mixing device (e.g., Banbury mixer or screw extruder). This "Masterbatch" can then be compounded with the filler and the other remaining ingredients to produce the final composition. A mix cycle of about 3 minutes is generally adequate for the Banbury mixer at an operating temperature usually between 325° and 375° F. The operating rate for the FCM unit generally will fall within ranges predicted by literature prepared by the Farrel Company, Ansonia, Connecticut. Again, temperatures between 325° and 375° F. are effective. In both cases, a very low plasticizer level, say about 2–3%, may require higher temperatures, while plasticizer levels above about 7% may mix well at lower mixer temperatures. While not evaluated, it is expected that other devices for handling viscous mixes (MI of 0.1 to 20) should be entirely satisfactory—but in any case, prototype trials in advance are desirable.

Once blends are mixed, routine commercial practices may be used, such as underwater melt cutting plus drying or use of sheeting plus chopping methods, to produce a final pelletized product.

Primary use for the compositions of the present invention will probably be in the sheeting field, particularly for low cost, dense, sound deadening structures. Outstanding characteristics such as improved "hand", "drape", reduced stiffness, and reduced thickness of the extruded sheeting result from the compositions of the present invention.

Other uses are possible. The principal advantage of this invention is that certain physical properties, such as flexibility and toughness, which are typically reduced when fillers are added to polymers, can be maintained within useful limits over a broad range of filler concentrations. Thus, this invention could be used in the manufacture of wire and cable compounds, of various molded parts, of sealants and caulks, or in other uses where flexibility and toughness are desired, coupled with the economies normally achieved by the incorporation of low cost fillers.

The blends of the present invention can readily be extruded onto a substrate, such as an automotive carpet, or can be extruded or calendered as unsupported film or sheet. Depending upon the equipment used, and the compounding techniques employed, it is possible to extrude wide range of film thickness, from below 20 mils to above 100 mils. This then provides industry with an opportunity to vary the amount of sound deadening to be attained by varying film thickness, density of blends, ratio of filler load to binder, and similar techniques well known in the art.

The sound-deadening sheet produced may be used in various ways:

When applied to automotive carpet, blends described are an effective and economic means to deaden sound, while also simultaneously serving as a moldable support for the carpet.

When used in sheet form, the blends can be installed in other areas of an automobile, truck, bus, etc., such as side panels, door panels, roofing areas, etc.

In sheet form, blends may be used as drapes or hangings to shield or to surround a noisy piece of factory equipment such as a loom, a forging press, etc.

In laminated sheet form, blends, faced with another material, might be used to achieve both a decorative and a functional use—such as dividing panels in an open-format office.

The application of the compositions of the present invention in carpets, and particularly in automotive carpets, is essentially identical to the methods as already described in U.S. Pat. No. 4,191,798, the disclosure of which is hereby incorporated by reference.

The following examples are given for the purpose of illustrating the present invention. All parts and percentages are by weight unless otherwise specified.

EXAMPLE 1 AND COMPARATIVE EXAMPLES 1 TO 7

These examples compare a compound prepared according to the present invention (Example 1) to similar compounds containing a variety of different plasticizers. Included is a useful composition based on U.S. Pat. No. 4,191,790 (comparative Example 1).

The basic composition used was 16.2% EVA #1 (25% vinyl acetate, 75% ethylene, 2.5 MI)

4.0% EVA #2 (7.5% vinyl acetate, 92.5% ethylene, 1.2 MI)

7.3% Plasticizer 72.5% #9 "Whiting" (calcium carbonate, as commercial ground limestone; Georgia Marble Co.)

The plasticizers used are indicated in Table I together with the results of physical property measurements. All of the blends were mixed on a two roll mill operating at 150°-170° C. The polymers were first added to the mill; after banding, all of the plasticizer was added gradually over a period of 1 to 2 min. The filler was then added gradually over a period of 1 to 2 minutes. All of the ingredients were then milled for an additional 5 minutes.

The compounds of examples C1 to C6 are very similar to one another in terms of their physical properties: the materials were somewhat rigid with flexural moduli ranging from about 13 to 18 Kpsi (92 to 126 Mpa), and elongation and tensile impact strength were very low. All of these samples were fairly brittle in that they could be broken easily when bent (see crease test results), with the exception of example C1, which only cracked slightly when folded. The compound of example C7 was very brittle and would be of little use commercially. However, the compound of Example 1 containing the polyester plasticizer was very flexible and showed no tendency to crack in the crease test; elongation and impact toughness were excellent considering the filler level of 70+%.

TABLE I

COMPARISON OF PLASTICIZER TYPES

| Plasticizer | Circosol 4240[1] | DOA[2] | DOS[3] | DOZ[4] | DOP[5] |
|---|---|---|---|---|---|
| Example No. | C1 | C2 | C3 | C4 | C5 |
| Density, g/cc | 1.78 | 1.79 | 1.76 | 1.77 | 1.81 |
| Flexural Modulus[9] | | | | | |
| MPa | 125.5 | 101.4 | 92,4 | 91.7 | 101.4 |
| kpsi | 18.2 | 14.7 | 13.4 | 13.3 | 14.7 |
| Tensile Strength[10] | | | | | |
| MPa | 2.8 | 3.4 | 2.9 | 2.4 | 3.2 |
| kpsi | 400 | 496 | 424 | 348 | 466 |
| Tensile Elongation[10] % | 23 | 23 | 23 | 23 | 23 |
| Tensile Impact[11] | | | | | |
| J/m[2] | 40,100 | 30,100 | 30,400 | 20,800 | 31,800 |
| ft-lb/in.[2] | 19.1 | 14.3 | 14.5 | 9.9 | 15.1 |
| Crease Test[12] | P− | F | F | F | F |

| Plasticizer | Phthalyl Glycolate[6] | Sulfonamide[7] | Polyester[8] |
|---|---|---|---|
| Example No. | C6 | C7 | 1 |
| Density | 1.80 | 1.91 | 1.81 |
| Flexural Modulus[9] | | | |
| MPa | 121.4 | 371 | 27.6 |
| kpsi | 17.6 | 53.8 | 4.0 |
| Tensile Strength[10] | | | |
| MPa | 2.4 | 4.9 | 1.7 |
| kpsi | 350 | 717 | 252 |

TABLE I-continued

COMPARISON OF PLASTICIZER TYPES

| | | | |
|---|---|---|---|
| Tensile Elongation % | 23 | 23 | 335 |
| Tensile Impact[11] | | | |
| J/m[2] | 4260 | 50,500 | 159,200 |
| ft-lb/in.[2] | 2 | 24.1 | 75.8 |
| Crease Test[12] | F | F | P |

[1]Naphthenic processing oil, Sun Oil Co.; viscosity 2525 Saybolt Universal Seconds at 100° F.
[2]Dioctyl adipate
[3]Dioctyl sebacate
[4]Dioctyl azelate
[5]Dioctyl phthalate
[6]"Santicizer" 316, Monsanto; butyl phthalyl butyl glycolate
[7]"Santicizer" 8, Monsanto; N—ethyl-o- and p-toluene-sulfonamide
[8]"Admex" 529, Ashland Oil Co., see Table III for further product information
[9]ASTM D-790, 0.2 inches/min; 0.050" (1.27 mm) nominal compression molded plaque
[10]ASTM D1708, 2 inches/min; 0.050" (1.27 mm) nominal molded laque
[11]ASTM 1822, type S; 0.50" (1.27 mm) nominal compression molded plaque
[12]Dead-bend crease; sample is folded sharply back upon itself (dead-bend). P = Pass, P⁻ = slight cracking at the fold edge, F = sample cracked at the fold.

EXAMPLES 2 TO 4

The composition of Example 2 was prepared on a two roll mill as described for Example 1 above. The compositions of Examples 3 and 4 were blended in a Banbury mixer. All of the ingredients were first charged into the chamber in an amount adequate to fill the entire chamber. The chamber was then closed using a ram pressure of 25 psi. The ingredients were mixed for 3½ minutes at a rotor speed of 280 rpm after the temperature leveled out; the maximum was 350° F. (180° C.).

The basic composition used was 16.2% EVA #1

4.0% EVA #2

7.3% polyester plasticizer 72.5% #9 "Whiting"

The polyester plasticizers used are indicated in Table II with physical properties of the compounds.

The data show that all of the polyester plasticizers examined in this comparison yield both similar reductions in flexural modulus and significantly improved elongation and impact strength. Although there seem to be some differences in performance among the polyesters, the differences are fairly small and the selection of plasticizer would probably be based on cost rather than the differences observed here.

All of the plasticizers of these Examples consist of condensation products of aliphatic dibasic acids and glycols. The "Santicizer" 334F, for example, consists of an acid component of adipic acid, and glycol component of 1,3-butane glycol. "Paraplex" G-25, as another example, consists of sebacic acid and propylene glycol. Infrared analysis confirms that the other two plasticizers ("Admex" 529 and "Santicizer" 429) consist of essentially similar components. Other property data are summarized in Table III. There appears to be no correlation between the performance of the polyester plasticizers in the blends and the properties shown in Table II as well as the other properties of the polyesters, such as acid number, which varies in these plasticizers by a factor of 4, and viscosity, which varies by two orders of magnitude.

EXAMPLES 5 TO 9

The compositions of these Examples were prepared in a Banbury mixer as described for Examples 3 and 4. All of these compounds contained 72.5% #9 "Whiting" nominally. The proportions of the remaining two components, the polymer and plasticizer, were adjusted relative to one another. The polymer used was an 18% vinyl acetate, 82% ethylene copolymer with a 2.5 melt index. The plasticizer was "Santicizer" 334F. The data are summarized in Table IV.

TABLE II

| POLYESTER PLASTICIZERS | | | | |
|---|---|---|---|---|
| Plasticizer | "Paraplex" G-25[1] | "Admex" 529[1] | "Santicizer" 334F[1] | "Santicizer" 429[1] |
| Example No. | 2 | 1 | 3 | 4 |
| Density, g/cc | 1.79 | 1.81 | 1.78 | 1.83 |
| Flexural Modulus | | | | |
| MPa | 15.8 | 27.6 | 18.6 | 55.8 |
| kpsi | 2.3 | 4.0 | 2.7 | 8.1 |
| Tensile Strength | | | | |
| MPa | 2.2 | 1.7 | 1.9 | 2.0 |
| psi | 318 | 252 | 280 | 297 |
| Tensile Elongation % | 438 | 335 | 365 | 362 |
| Tensile Impact | | | | |
| $J/m^2$ | 165,800 | 159,200 | 121,300 | 134,900 |
| ft-lb/in.$^2$ | 79 | 75.8 | 57.8 | 64.2 |
| Crease Test | P | P | P | P |

(1)The plasticizers are described in detail in Table III.

TABLE III

| POLYESTER PLASTICIZERS PHYSICAL PROPERTY DATA | | | | |
|---|---|---|---|---|
| | "Santicizer" 334F | "Santicizer" 429 | "Paraplex" G-25 | "Admex" 529 |
| Molecular Weight | (1) | (1) | 8000(2) | (1) |
| Specific Gravity | 1.082 | 1.10 | 1.06 | 1.12 |
| Freezing Point, °C. | — | <−60 | 15 | — |
| Acid Number mg KOH/g | 0.7 | 2.2 | 1.4 | 3 |
| Viscosity @ 25° C. | 35 | 55 | 2200 | 55 |

Note:
(1)Described as medium molecular weight.
(2)Described as high molecular weight.

TABLE IV

| EFFECT OF PLASTICIZER CONTENT | | | | | |
|---|---|---|---|---|---|
| Polymer Content Wt. % | 20.2 | 21.8 | 23.3 | 25.4 | 26.9 |
| Plasticizer Content, Wt. % | 7.3 | 5.7 | 4.2 | 2.1 | 1 |
| Example No. | 5 | 6 | 7 | 8 | 9 |
| Density g/cc | 1.79 | 1.79 | 1.82 | 1.74 | 1.77 |
| Flexural Modulus | | | | | |
| MPa | 17.9 | 40.7 | 90.3 | 321 | 340 |
| kpsi | 2.6 | 2.9 | 13.1 | 46.6 | 49.2 |
| Tensile Strength | | | | | |
| MPa | 1.8 | 2 | 2.6 | 3 | 5.6 |
| psi | 260 | 290 | 372 | 430 | 813 |
| Tensile Elongation % | 274 | 282 | 354 | 68 | 23 |
| Tensile Impact | | | | | |
| $J/m^2$ | 129,000 | 160,000 | 198,000 | (*) | 6900 |
| ft-lb/in.$^2$ | 61 | 76 | 89 | | 3.3 |
| Crease Test | P | P | P | P | P− |

(*) Too brittle to measure

The data illustrate clearly the attractive balance of properties achievable at this high filler level by adjusting plasticizer content. Also, comparison of the properties of Example 7 with those of Example C1, Table I, again demonstrate the unique behavior of the polyester plasticizer. That is, at reasonably comparable modulus and tensile strength, the compound plasticized with the polyester had markedly better elongation, flexibility (i.e., flex crack resistance) and tensile impact strength.

EXAMPLE 10

The composition of Example 10 containing 80% by weight filler was prepared in a Banbury mixer as described in Examples 3 and 4. The composition and its physical properties are summarized in Table V. The data show that the polymer and plasticizer content can be reduced significantly and still one can obtain physical properties which would probably be adequate as a sound deadening backing for carpeting.

EXAMPLES 11 TO 16 AND COMPARATIVE EXAMPLE 8

All examples were prepared in a Banbury mixer as described in Examples 3 and 4. The basic composition of Examples 11 to 16 was 20.2% Polymer
7.3% "Santicizer" 334F
72.5% #9 "Whiting"

The polymers used and the properties of the compositions are listed in Table VI. The composition of Example C8 was similar to that of Example 15 with the exception that "Circosol" 4240 was used as a plasticizer instead of "Santicizer" 334F.

The data show that with increasing vinyl acetate content of the copolymer component, flexural modulus generally decreases, elongation and tensile impact strength generally increase. Also, the properties of Example 11, containing a copolymer with only 7.5% vinyl acetate, are probably adequate as a sound deadening backing for carpeting. Finally, a comparison of Example 15 and C8 again show how flexibility, in terms of flexural modulus and flex crack resistance, and toughness are improved when the polyester plasticizer is used.

TABLE V

| EFFECT OF FILLER CONCENTRATION | | | |
|---|---|---|---|
| EVA #1 | Wt. % | 16.2 | 11.8 |
| EVA #2 | Wt. % | 4.0 | 2.9 |
| "Santicizer" 334F | Wt. % | 7.3 | 5.3 |
| Filler Level | Wt. % | 72.5 | 80 |
| Example No. | | 3 | 10 |
| Density | g/cc | 1.78 | 1.99 |
| Flexural Modulus | MPa | 18.8 | 90 |
| | kpsi | 2.7 | 13 |
| Tensile Strength | MPa | 2 | 1.2 |
| | psi | 280 | 179 |
| Tensile Elongation | % | 365 | 304 |
| Tensile Impact | $J/m^2$ | 121,300 | 74,000 |
| | ft-lb/in.$^2$ | 57.8 | 35 |
| Crease Test | | P | P |

TABLE VI

| COMPARISON OF COPOLYMER VAc CONTENT | | | | | | | | |
|---|---|---|---|---|---|---|---|---|
| VAc Content, % | | 7.5(1) | 9.3(2) | 12(3) | 15(4) | 18(5) | 25(6) | 18(5) |
| Example # | | 11 | 12 | 13 | 14 | 15 | 16 | C8 |
| Density | g/cc | 1.76 | 1.79 | 1.79 | 1.76 | 1.78 | 1.79 | 1.78 |
| Flexural Modulus | MPa | 89.6 | 44.8 | 51 | 30.3 | 32.4 | 26.2 | 179 |
| | kpsi | 13.0 | 6.5 | 7.4 | 4.4 | 4.7 | 3.8 | 25.9 |
| Tensile Strength | MPa | 1.9 | 1.9 | 1.7 | 1.8 | 1.7 | 2.2 | 4.4 |

TABLE VI-continued

| COMPARISON OF COPOLYMER VAc CONTENT | | | | | | | | |
|---|---|---|---|---|---|---|---|---|
| | psi | 278 | 270 | 244 | 258 | 246 | 313 | 640 |
| Tensile Elongation | % | 110 | 145 | 148 | 202 | 255 | 438 | 23 |
| Tensile Impact | $J/m^2$ | 22,500 | 32,600 | 86,200 | 141,000 | 131,000 | 162,000 | 36,000 |
| | $ft\text{-}lb/in.^2$ | 10.7 | 15.5 | 41 | 66.9 | 62.3 | 77.2 | 17.1 |
| Crease Test | | P− | P | P | P | P | P | F |

(1)EVA #2
(2)EVA #3: 9.3% vinyl acetate, 90.7% ethylene; 2.0 MI
(3)EVA #4: 12% vinyl acetate, 88% ethylene; 2.5 MI
(4)EVA #5: 15% vinyl acetate, 85% ethylene; 2.5 MI
(5)EVA #6: 18% vinyl acetate, 82% ethylene; 2.5 MI
(6)EVA #1

EXAMPLES 17 TO 19

All of these examples were prepared in a Banbury mixer as described in Examples 3 and 4. The basic composition used was
20.2% Polymer
7.3% "Santicizer" 334F
72.5% #9 "Whiting"
The polymers used are listed in Table VII together with physical properties of the blends.

The data suggest that as the melt index of the copolymer component is reduced, plasticizer efficiency improves somewhat, as indicated by the reduction in flexural modulus. Tensile strength also increases slightly; elongation and tensile impact strength increase significantly. In general, all the properties measured improved. However, the properties of Example 19 containing the copolymer with a melt index of 150 have generally declined, but are probably still acceptable as a sound deadening backing for carpeting.

EXAMPLES 20 AND 21

Examples 20 and 21 were prepared on a two roll mill as described in Example 1. The composition used was
20.2% Polymer
7.3% "Santicizer" 334F
72.5% "#9 Whiting"
The polymers used are listed in Table VIII together with the physical properties. The compounds are examples of the most preferred compositions. The data demonstrate both the range of properties available in this type of composition and the basic equivalence of the compound based on the two different types of copolymers. This basic formulation would be a logical starting point for a compounder because it offers an excellent balance of properties.

TABLE VII

| EFFECT OF POLYMER MELT INDEX | | | | | | |
|---|---|---|---|---|---|---|
| VAc Level, % | | 12(1) | 12(2) | 18(3) | 18(4) | 18(5) |
| Melt Index | g/10 min | 2.5 | 0.35 | 2.5 | 0.7 | 150 |
| Example No. | | 13 | 17 | 15 | 18 | 19 |
| Density | g/cc | 1.79 | 1.76 | 1.78 | 1.79 | 1.81 |
| Flexural Modulus | MPa | 51 | 42.7 | 32.4 | 23.4 | 27.6 |
| | kpsi | 7.4 | 6.2 | 4.7 | 3.4 | 4 |
| Tensile Strength | MPa | 1.7 | 2 | 1.7 | 2.4 | 0.6 |

TABLE VII-continued

| EFFECT OF POLYMER MELT INDEX | | | | | | |
|---|---|---|---|---|---|---|
| | psi | 244 | 285 | 246 | 344 | 84 |
| Tensile Elongation | % | 148 | 167 | 255 | 335 | 80 |
| Tensile Impact | $J/m^2$ | 86,200 | 144,000 | 131,000 | 164,000 | 31,100 |
| | $ft\text{-}lb/in.^2$ | 41 | 68.8 | 62.3 | 78.0 | 14.8 |
| Crease Test | | P | P | P | P | P |

(1)EVA #4
(2)EVA #7: 12% vinyl acetate, 88% ethylene; 0.35 MI
(3)EVA #6
(4)EVA #8: 18% vinyl acetate, 82% ethylene; 0.7 MI
(5)EVA #9: 18% vinyl acetate, 82% ethylene; 150 MI

EXAMPLES 22 AND 23

These examples were prepared in a Banbury mixer using the conditions described in Examples 3 and 4. The composition used was
16.2% EVA #1
4.0% EVA #2
7.3% Plasticizer
72.5% #9 "Whiting"
The plasticizer used was a mixture of "Santicizer" 334F and "Circosol" 4240. The relative proportions are indicated in Table IX, together with the physical properties of the compounds. Examples C1 and 3 have been included for comparison. Examples 22 and 23 represent most preferred compositions when using a mixture of the hydrocarbon processing oil and polyester plasticizers. The data deomonstrate the significant improvement in elongation and flex crack resistance, while maintaining a comparable level of tensile strength, when a relatively small amount of the polyester is used in conjunction with the processing oil.

TABLE VIII

| COMPOUNDS BASED ON E/VA AND E/MA COPOLYMERS | | | |
|---|---|---|---|
| Comonomer Type | | VAc(1) | MA(2) |
| Example # | | 20 | 21 |
| Density | g/cc | 1.82 | 1.81 |
| Flexural Modulus | MPa | 31.0 | 26.2 |
| | kpsi | 4.5 | 3.8 |
| Tensile Strength | MPa | 1.7 | 1.4 |
| | psi | 242 | 208 |
| Tensile Elongation | % | 297 | 301 |
| Tensile Impact | $J/m^2$ | 109,000 | 120,700 |
| | $ft\text{-}lb/in.^2$ | 51.9 | 57.5 |
| Crease Test | | P | P |

(1)EVA #6
(2)EMA #1: 18% methyl acrylate (MA), 82% ethylene; 2.5 MI

TABLE IX

| Plasticizer Component (overall conc: 7.3%) | 100% "Circosol" 4240 | MIXED PLASTICIZERS 90% "Circosol" 4240 10% "Santicizer" 334F | 75% "Circosol" 4240 25% "Santicizer" 334F | 100% "Santicizer" 334F |
|---|---|---|---|---|
| Example No. | C1 | 22 | 23 | 3 |
| Density g/cc | 1.78 | 1.78 | 1.79 | 1.78 |
| Flexural Modulus | | | | |
| MPa | 125.5 | 103 | 76 | 18.8 |
| kpsi | 18.2 | 15.0 | 11.0 | 2.7 |
| Tensile Strength | | | | |
| MPa | 2.8 | 2.5 | 2.6 | 1.9 |
| psi | 400 | 358 | 379 | 280 |
| Tensile Elongation % | 23 | 487 | 582 | 365 |
| Tensile Impact | | | | |
| $J/m^2$ | 40,100 | — | — | 121,300 |
| ft-lb/in.$^2$ | 19.1 | | | 57.8 |
| Crease Test | P− | P | P | P |

EXAMPLES 24 TO 27

These examples were prepared in a Banbury mixer using the conditions described in Examples 3 and 4. The compositions are indicated in Table X together with the physical property data. The results show the effectiveness of the polyethers as a plasticizer in these highly filled blends (about 72.5% #9 "Whiting"). The compatibility of this polyether triol is less than that of the polyester, even though the molecular weights of the two types of plasticizers are similar. The balance of properties achieved using the polyether differs from that obtained with the polyester in that the polyether plasticized compositions are stiffer and somewhat stronger in terms of tensile strength; flex crack resistance appears to be unaffected.

The data also show the significantly better performance obtained with the copolymer triol, Example 25, versus that of the propylene oxide homopolymer triol, Example 27, in terms of flexural modulus, tensile elongation, impact strength, and flex crack resistance.

TABLE X

| POLYETHER PLASTICIZERS | | | | | | |
|---|---|---|---|---|---|---|
| Example # | 7 | 24 | 25 | 16 | 26 | 27 |
| Polymer Type | EVA #6 | EVA #6 | EVA #6 | EVA #1 | EVA #1 | EVA #6 |
| Polymer Conc. wt % | 23.3 | 20.2 | 23.8 | 20.2 | 23.8 | 23.8 |
| Plasticizer Type | Polyester | Polyether(2) | Polyether(2) | Polyester | Polyether(2) | Polyether(3) |
| Plasticizer Conc. wt % | 4.2 | 7.3 | 3.7 | 7.3 | 3.7 | 3.7 |
| Density g/cc | 1.82 | ↑ | 1.76 | 1.79 | 1.80 | 1.78 |
| Flexural Modulus MPa | 90.3 | ↑ | 222 | 26.2 | 116 | 288 |
| Kpsi | 13.1 | DID | 32.2 | 3.8 | 16.8 | 41.8 |
| Tensile Strength MPa | 2.6 | | 3.4 | 2.2 | 3.4 | 6.2 |
| psi | 372 | NOT | 487 | 313 | 499 | 903 |
| Tensile Elongation % | 354 | TEST(1) | 213 | 438 | 468 | 23 |
| Tensile Impact | | ↓ | | | | |
| $J/m^2$ | 198,000 | ↓ | 88,600 | 162,000 | 209,200 | 33,900 |
| ft-lb/in.$^2$ | 89 | ↓ | 42 | 77.2 | 100 | 16.2 |
| Crease Test | P | ↓ | P | P | P | F |

(1)Heavy migration of plasticizer to sample surface during compression molding.
(2)"Polyglycol" 15-200. Molecular weight: 2500; a triol based on a random copolymer of ethylene and propylene oxides; available from Dow Chemical Co.
(3)"Pluracol" TP 1540. Molecular weight: 1500; a triol based on propylene oxide; available from BASF Wyandotte.

EXAMPLES 28 AND 29 AND COMPARATIVE EXAMPLES 9 AND 10

These compositions were prepared according to the procedure described in Examples 3 and 4. All compositions contained 72.5% #9 "Whiting" and 7.3% plasticizer and 20.2% ionomer. These examples demonstrate that by using, in an ionomer based composition, a polyester plasticizer instead of a hydrocarbon oil, flexural modulus and in some cases tensile strength, can be increased dramatically without affecting elongation significantly. These properties can be important in sound deadening structures that are unsupported. The data are summarized in Table XI.

TABLE XI

| | Example # 28 | C9 | 29 | C10 |
|---|---|---|---|---|
| Ionomer Type | (1) | (1) | (2) | (2) |
| Plasticizer Type | "Plastolein" 9776(3) | "Circosol" 4240 | "Plastolein" 9776 | "Circosol" 4240 |
| Density, g/cc | 1.80 | 1.70 | 1.81 | 1.77 |
| Flexural Modulus | | | | |
| MPa | 1000 | 483 | 1214 | 593 |
| kpsi | 145 | 70 | 176 | 86 |
| Tensile Strength, | | | | |
| MPa | 12.5 | 6.5 | 10.7 | 11 |
| psi | 1816 | 946 | 1556 | 1600 |
| Tensile Elongation, % | 11 | 11 | 6 | 11 |

(1) 8.7% methacrylic acid, 91.3% ethylene, neutralized with $Zn^{++}$, 5 MI
(2) 10% methacrylic acid, 90% ethylene, neutralized with $Na^{+}$, 1.4 MI
(3) "Plastolein" 9776: polyester plasticizer, Emery Industries, Inc., medium-high molecular weight; specific gravity, 1.08; acid number, 1.4 mgKOH/g; viscosity @100° F., 28 poise; solidification point −20° C.

EXAMPLES 30 AND 31

These compositions were prepared in a Banbury mixer as described in Examples 3 and 4. They contain 72.5% #9 "Whiting" filler, 7.3% polyester plasticizer and 20.2% polymer. The data obtained are summarized in Table XII. Data for Example 15, containing only the ethylene/vinyl acetate copolymer used in Examples 30 and 31 are included for comparison. The incorporation of an EPDM rubber, especially in small amounts, results in a significant decrease in flexural modulus without deterioration of other properties.

TABLE XII

| Example # | 15 | 30 | 31 |
|---|---|---|---|
| Polymer component(s) | | | |
| EVA #6, % | 20.2 | 18.2 | 10.1 |
| EPDM[1], % | 0 | 2 | 10.1 |
| Density, g/cc | 1.78 | 1.82 | 1.82 |
| Flexural Modulus | | | |
| MPa | 32.4 | 19.3 | 15.2 |
| kpsi | 4.7 | 2.8 | 2.2 |
| Tensile Strength, | | | |
| MPa | 1.7 | 1.7 | 0.9 |
| psi | 246 | 248 | 136 |
| Tensile Elongation, % | 255 | 338 | 228 |
| Crease Test | P | P | P |

[1]68% ethylene/26% propylene/6% 1,4-hexadiene; Mooney viscosity 34 @ 150° C.

EXAMPLES 32–35 AND COMPARATIVE EXAMPLE 11

These compositions were prepared in a Banbury mixer according to the procedure described in Examples 3 and 4. They all contain 50% #9 "Whiting" and 2% polyester plasticizer and 48% polymer. The compositions and the physical property data are summarized in Table XIII. The data show that both flexural modulus and tensile strength are increased significantly when the high density ethylene homopolymer (HDPE) is included in the composition. In terms of properties required in many sound deadening applications the optimum benefit with respect to modulus and strength is achieved at an HDPE concentration of 24 to 38.4% by weight. The peel strength values shown in Table XIII suggest that the minimum level of the ethylene copolymer should be about 9.6% by weight in order to obtain adequate adhesion strength with these compositions.

TABLE XIII

| Example # | 32 | 33 | 34 | 35 | C11 |
|---|---|---|---|---|---|
| Polymer component(s) | | | | | |
| EVA #6, % | 48 | 38.4 | 24 | 9.6 | 0 |
| HDPE, % | 0 | 9.6 | 24 | 33.4 | 48 |
| Density | 1.44 | 1.45 | 1.46 | 1.45 | 1.47 |
| Flexural Modulus | | | | | |
| MPa | 126 | 355 | 806 | 1771 | 2181 |
| kpsi | 19.7 | 39.9 | 126 | 277 | 341 |
| Tensile Strength | | | | | |
| MPa | 5.7 | 4.7 | 8.9 | 15 | 15.3 |
| psi | 896 | 742 | 1386 | 2340 | 2392 |
| Tensile Elongation, % | 520 | 205 | 16 | 5 | 5 |
| Peel strength[2] | | | | | |
| gram/inch | — | — | 160 | 140 | 0 |

[1]High density ethylene homopolymer, density, 0.955 g/cc, 2.8 MI.

[2]Film samples, 0.004 to 0.006 inches in thickness, were prepared by compression molding at 175° C. Film strips, 1" in width, were heat sealed together at a temperature of 130° C., and at a pressure of 40 psi and a dwell time of 6 sec using a model 12 ASL Sentinel Heat Sealer, produced by Packaging Industries, Hyannis, Massachusetts. After cooling to room temperature (ca. 25° C.) the samples were peel tested immediately at 12 inch/minute on a peel tester produced by Alfred Suter Co., New York, New York.

I claim:

1. A composition consisting essentially of (a) from about 5 to about 55% by weight of at least one copolymer of ethylene with at least one comonomer selected from the group consisting of vinyl esters of saturated carboxylic acids wherein the acid moiety has up to 4 carbon atoms, unsaturated mono- or dicarboxylic acids of 3 to 5 carbon atoms, salts of said unsaturated acids, and esters of said unsaturated acids wherein the alcohol moiety has 1 to 8 carbon atoms, the ethylene content of said copolymer being from about 40 to about 95% by weight, the comonomer content of said copolymer being from about 5 to about 60% by weight, and the melt index of said copolymer being from about 0.1 to about 150, provided that when said copolymer of ethylene is an ethylene/vinyl ester or ethylene/unsaturated mono- or dicarboxylic acid ester copolymer said copolymer can contain up to about 15 percent by weight of carbon monoxide or sulfur dioxide; (b) from about 1 to about 15 percent by weight of at least one plasticizer selected from the group consisting of polyesters, polyethers, polyether esters, and combinations thereof with processing oil, wherein said polyester is a liquid condensation product of ($\alpha$) dibasic acid selected from the group consisting of saturated aliphatic dibasic acids and aromatic dibasic acids and ($\beta$) polyol selected from the group consisting of aliphatic polyols and polyoxyalkylene polyols; (c) from about 40 to about 90% by weight of filler; (d) from 0 to about 27.5% by weight of unvulcanized elastomeric polymer; and (e) from 0 to about 44% by weight of olefin polymer selected from the group consisting of low density branched polyethylene, high density linear polyethylene, linear copolymers of ethylene and another olefin comonomer, polypropylene and copolymers of propylene and ethylene where the ethylene content is up to 20% by weight.

2. The composition of claim 1 wherein said elastomeric polymer and said olefin polymer are present in an amount of 0% by weight.

3. The composition of claim 2 wherein (a) said copolymer of ethylene is present in an amount of from about 10 to about 50 percent by weight, the ethylene content of said copolymer being from about 45 to about 90% by weight, the comonomer content of said copolymer being from about 10 to about 55 percent by weight and the melt index of said copolymer being from about 0.3 to about 50; (b) said plasticizer is present in an amount of from about 2 to about 12 percent by weight; and (c) said filler is present in an amount of from about 50 to about 85 percent by weight.

4. The composition of claim 3 wherein said filler is selected from the group consisting of calcium carbonate, barium sulfate, hydrated alumina, clay, magnesium carbonate, calcium sulfate, silica, flyash, cement dust, wood flour, ground rice hulls and mixtures thereof.

5. The composition of claim 4 wherein said filler is selected from the group consisting of calcium carbonate, barium sulfate, hydrated alumina, and mixtures thereof.

6. The composition of claim 5 wherein said plasticizer is a polyester that is a liquid condensation product of (a) dibasic acid selected from the group consisting of saturated aliphatic dibasic acids and aromatic dibasic acids and (b) polyol selected from the group consisting of aliphatic polyols and polyoxyalkylenepolyols.

7. The composition of claim 6 wherein said dibasic acid is selected from the group consisting of adipic acid, azelaic acid, phthalic acid, sebacic acid, glutaric acid and mixtures thereof.

8. The composition of claim 7 wherein said polyol is selected from the group consisting of ethylene glycol, propylene glycol, 1,3-butane glycol, 1,4-butane glycol, diethylene glycol and polyethylene glycol.

9. The composition of claim 8 wherein more than 50 percent by weight of the dibasic acids employed are aliphatic dibasic acids and wherein the polyol is selected from the group consisting of aliphatic polyols.

10. The composition of claim 9 wherein said dibasic acid is selected from the group consisting of adipic acid and azelaic acid and wherein said polyol is selected from the group consisting of propylene glycol, 1,3-butane glycol and 1,4-butane glycol.

11. The composition of claim 5 wherein said plasticizer is a polyether selected from polyols based on random or block copolymers of ethylene oxides or propylene oxides.

12. The composition of claim 5 wherein said plasticizer is a polyether ester selected from esters of polyols based on polymers or copolymers of ethylene oxides or propylene oxides.

13. The composition of claim 5 wherein said plasticizer consists essentially of from about 50 to about 95 percent by weight of processing oil and from about 5 to about 50 percent by weight of at least one additional plasticizer selected from the group consisting of polyesters, polyethers and polyether esters.

14. The composition of claim 13 wherein said plasticizer consists essentially of from about 50 to about 80 percent by weight processing oil and from about 20 to about 50 percent by weight of at least one additional plasticizer selected from the group consisting of polyesters, polyethers and polyether esters.

15. The composition of claim 5 wherein said copolymer of ethylene is selected from the group consisting of ethylene/vinyl acetate, ethylene/acrylic acid and its ionomers, ethylene/methacrylic acid and its ionomers, ethylene/methyl acrylate, ethylene/ethyl acrylate, ethylene/isobutyl acrylate, ethylene/normal butyl acrylate, ethylene/isobutyl acrylate/methacrylic acid and its ionomers, ethylene/normal butyl acrylate/methacrylic acid and its ionomers, ethylene/isobutyl acrylate/acrylic acid and its ionomers, ethylene/normal butyl acrylate/acrylic acid and its ionomers, ethylene/-methyl methacrylate, ethylene/vinyl acetate/methacrylic acid and its ionomers, ethylene/vinyl acetate/acrylic acid and its ionomers, ethylene/vinyl acetate/carbon monoxide, ethylene/methyl acrylate/carbon monoxide, ethylene/normal butyl acrylate/carbon monoxide, ethylene/isobutyl acrylate/carbon monoxide, ethylene/vinyl acetate/monoethyl maleate and ethylene/methyl acrylate/monoethyl maleate.

16. The composition of claim 15 wherein said copolymer of ethylene is selected from the group consisting of ethylene/vinyl acetate, ethylene/ethyl acrylate, ethylene/methyl acrylate, ethylene/isobutylacrylate and ethylene/methyl methacrylate.

17. The composition of claims 5, 8, 11, 12, 14 or 16 wherein (a) said copolymer of ethylene is present in an amount of from about 15 to about 30 percent by weight; the ethylene content of said copolymer being from about 60 to about 85 percent by weight, the comonomer content of said copolymer being from about 15 to about 40 percent by weight, and the melt index of said copolymer being from about 0.1 to about 10; (b) said plasticizer is present in an amount of from about 3 to about 8 percent by weight when the filler is selected from the group consisting of calcium carbonate and hydrated alumina and from about 4 to about 8 percent by weight when the filler is barium sulfate; and (c) said filler is present in an amount of from about 65 to about 80 percent by weight when the filler is selected from the group consisting of calcium carbonate and hydrated alumina and from about 70 to about 85 percent by weight when the filler is barium sulfate.

18. The composition of claims 1, 5, 8, 11, 12, 14 or 16 in the form of a sound-deadening sheet.

19. A carpet having a backside coating consisting essentially of the composition of claims 1, 5, 8, 11, 12, 14 or 16.

20. An automotive carpet having a backside coating consisting essentially of the composition of claims 1, 5, 8, 11, 12, 14 or 16.

21. The composition of claims 6, 11, 12, 14 or 16 containing at least one modifier selected from the following groups (d) from 0 to about 27.5% by weight of unvulcanized elastomeric polymer; and (e) from 0 to about 44% by weight of olefin polymer selected from the group consisting of low density branched polyethylene, high density linear polyethylene, linear copolymers of ethylene and another olefin comonomer, polypropylene and copolymers of propylene and ethylene where the ethylene content is up to 20% by weight.

22. The composition of claims 6, 11, 12, 14 or 16 containing at least one modifier selected from the following groups (d) unvulcanized elastomeric polymer selected from the group consisting of styrene-butadiene rubber, polyisobutylene, ethylene/propylene rubber, and terpolymers of ethylene, propylene and a diene monomer; and (e) olefin polymer selected from the group consisting of high density linear polyethylene, linear copolymers of ethylene and another olefin comonomer, and copolymers of propylene and ethylene where the ethylene is up to 20% by weight, provided that when present at all component (d) is present in an amount of from about 1 to about 22.5% by weight and component (e) is present in an amount of from about 1 to about 37.5% by weight.

23. The composition of claims 6, 11, 12, 14 or 16 containing at least one modifier selected from the following groups (d) unvulcanized elastomeric polymer selected from the group consisting of ethylene/propylene rubber and terpolymers of ethylene, propylene and a diene monomer, wherein the ethylene content is from above 20 to about 80% by weight and the diene content is from 0 to about 5% by weight, said dienes being selected from the group consisting of methylene norbornene, ethylidene norbornene, dicyclopentadiene and 1,4-hexadiene; and (e) olefin polymer selected from the group consisting of high density linear polyethylene, linear copolymers of ethylene and another olefin comonomer, and copolymers of propylene and ethylene where the ethylene content is up to 20% by weight, provided that when present at all component (d) is present in an amount of from about 2 to about 12% by weight and component (e) is present in an amount of from about 3 to about 18% by weight.

* * * * *